US006579143B1

(12) United States Patent
Rehkemper et al.

(10) Patent No.: US 6,579,143 B1
(45) Date of Patent: Jun. 17, 2003

(54) TWISTING AND DANCING FIGURE

(75) Inventors: Steven Rehkemper, Chicago, IL (US); Dennis O'Patka, Chicago, IL (US); Peter Greenley, Chicago, IL (US); Scott May, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/207,452

(22) Filed: Jul. 30, 2002

(51) Int. Cl.[7] ..... A63H 11/00

(52) U.S. Cl. ..... 446/330; 446/268; 446/353; 446/298; 446/175; 446/354

(58) Field of Search ..... 446/175, 330, 446/355, 354, 353, 352, 334, 297, 268; 40/418, 419, 420

(56) References Cited

U.S. PATENT DOCUMENTS

| | | | | |
|---|---|---|---|---|
| 1,383,780 A | * | 7/1921 | Zaiden | 446/354 |
| 2,105,904 A | * | 1/1938 | Dale | 446/354 |
| 3,583,098 A | * | 6/1971 | Bear et el. | 446/355 |
| 4,875,886 A | * | 10/1989 | Sung | 446/298 |
| 5,176,560 A | | 1/1993 | Wetherell et al. | 446/175 |
| 5,273,479 A | | 12/1993 | Chang | 446/272 |
| 5,601,471 A | | 2/1997 | Kennedy | 446/236 |
| 5,820,441 A | | 10/1998 | Pracas | 446/354 |
| 5,911,617 A | | 6/1999 | Chou | 446/353 |
| 6,261,148 B1 | | 7/2001 | Robinson | 446/353 |
| 6,371,827 B1 | * | 4/2002 | Chou | 446/354 |

FOREIGN PATENT DOCUMENTS

| | | | | |
|---|---|---|---|---|
| JP | 01221192 A | * | 9/1989 | A63H/11/18 |

* cited by examiner

*Primary Examiner*—Derris H. Banks
*Assistant Examiner*—Urszula Cegielnik

(57) ABSTRACT

There is provided in one embodiment a twisting figure that includes a head and body having a pair of arms and a lower leg section separately extending therefrom. A housing formed in the body contains a motor secured between a pair of horizontal plates. The plates are pivotally secured to the lower leg section. A combo gear is secured to the upper plate and in communication with the motor. The combo gear is arranged to reciprocate against a bumper that is secured to the lower leg section. When the combo gear reciprocates against the bumper, the pair of plates pivots back and forth causing the twisting figure to move therewith. The figure may also include a worm gear in communication with the motor and the pair of arms, such that when the motor rotates the pair of arms move upwardly or downwardly.

13 Claims, 4 Drawing Sheets

TWISTING AND DANCING FIGURE

FIELD OF THE INVENTION

This invention relates generally to animated toys and more particularly to dolls and figures that are mechanically animated to simulate movements.

BACKGROUND OF THE INVENTION

Toy dancing figures are well known in the art and have employed many various aesthetic novelty designs, from flowers (U.S. Pat. No. 5,056,249) and soda cans to fish (U.S. Pat. No. 4,775,351). However, these lack the innovation to create complex animated movements needed for dolls and for various other standing figures.

While the prior art is not devoid of dancing dolls, toys or other figures, there are disadvantages in the prior art and areas that need improvement. For instance, one disadvantage that exists is most animated figures employ reciprocating motors to the direction of the movement. When employing reciprocating motors to change the direction of the movement, the figures and especially the mechanics exhibit extreme wear and tear caused by the constant direction change.

Another disadvantage is that most of the dolls are fixed on a base in order to provide stability, lacking a more lifelike appearance that free-standing figures provide. These non-free standing figures typically include mechanisms in the base and are often comprised of moveable rods that travel through the legs that create or control the movements of the figure. These dancing toys may be represented in U.S. Pat. Nos. 6,163,992; 6,126,508; 5,601,471; and 5,273,479. Other non-free standing figures incorporate the mechanisms in the upper or lower torso, but since this type of arrangement causes the figure to be top-heavy, the figures rely on the base to keep the figures upright. For example, U.S. Pat. No. 6,261,148 discloses a twisting figure; U.S. Pat. No. 6,071,170 discloses a figure that vibrates and moves side to side; and U.S. Pat. No. 5,735,726 illustrates an animated figure that stands and sits.

While free-standing animated dolls are present in the art, these dolls limit the movement to the legs or reduce the speed or rate of animation so the figures do not fall. As such these dolls typically only walk, illustrated in U.S. Pat. No. 5,820,441; tap dance, disclosed in U.S. Pat. No. 5,147,238; or sway from one side to another, shown in U.S. Pat. No. 5,911,617.

Another interesting disclosure is found in U.S. Pat. No. 5,176,560, which discloses a free-standing dancing doll. While the mechanism that powers the movement is situated in the torso of the doll, rods are used to transfer the movement to the legs. This will increase the instability of the doll, which will require the speed of the movement to reduce.

As such there exists a need to improve upon the prior art without the disadvantages outlined above.

SUMMARY OF THE INVENTION

In accordance with the present invention, there is provided in one embodiment a twisting figure that includes a head and body portion having a pair of arms and a lower leg section separately extending therefrom. The figure also has a housing formed in the body portion that contains a motor secured between upper and lower horizontal plates. The horizontal plates are further pivotally secured to the lower leg section. The housing contains a combo gear secured to the upper horizontal plate and in communication with the motor. The combo gear is arranged to alternately push against a bumper, which is secured through the lower horizontal plate to the lower leg section. As such when the combo gear alternately pushes against the bumper, the pair of horizontal plates pivots back and forth along a horizontal plane causing the body portion to move therewith. The figure may also include a worm gear in communication with the motor. The worm gear is meshed to a pair of arm drive gears that are separately in communication with one of the arms, such that when the arm drive gears rotate the pair of arms move upwardly or downwardly.

The figure may further include a slider gear in communication with the motor and positioned to engage and rotate the combo gear only when the motor is operating in a forward direction. It is important to note that a reciprocating motor does still not control the twisting of the body and it is used such that the doll may move its arms independently of the twisting movement. The figure may also include a pair of shoes attached to the lower leg section and a pair of freely rotatable rollers attached under the shoes, such that legs may move when the body twists. In addition thereto, the figure may also include a speaker that emits pre-programmed sounds and music.

Numerous other advantages and features of the invention will become readily apparent from the following detailed description of the invention and the embodiments thereof, from the claims, and from the accompanying drawings.

BRIEF DESCRIPTION OF THE FIGURES

A fuller understanding of the foregoing may be had by reference to the accompanying drawings, wherein.

DETAILED DESCRIPTION OF THE INVENTION

Figure 1:
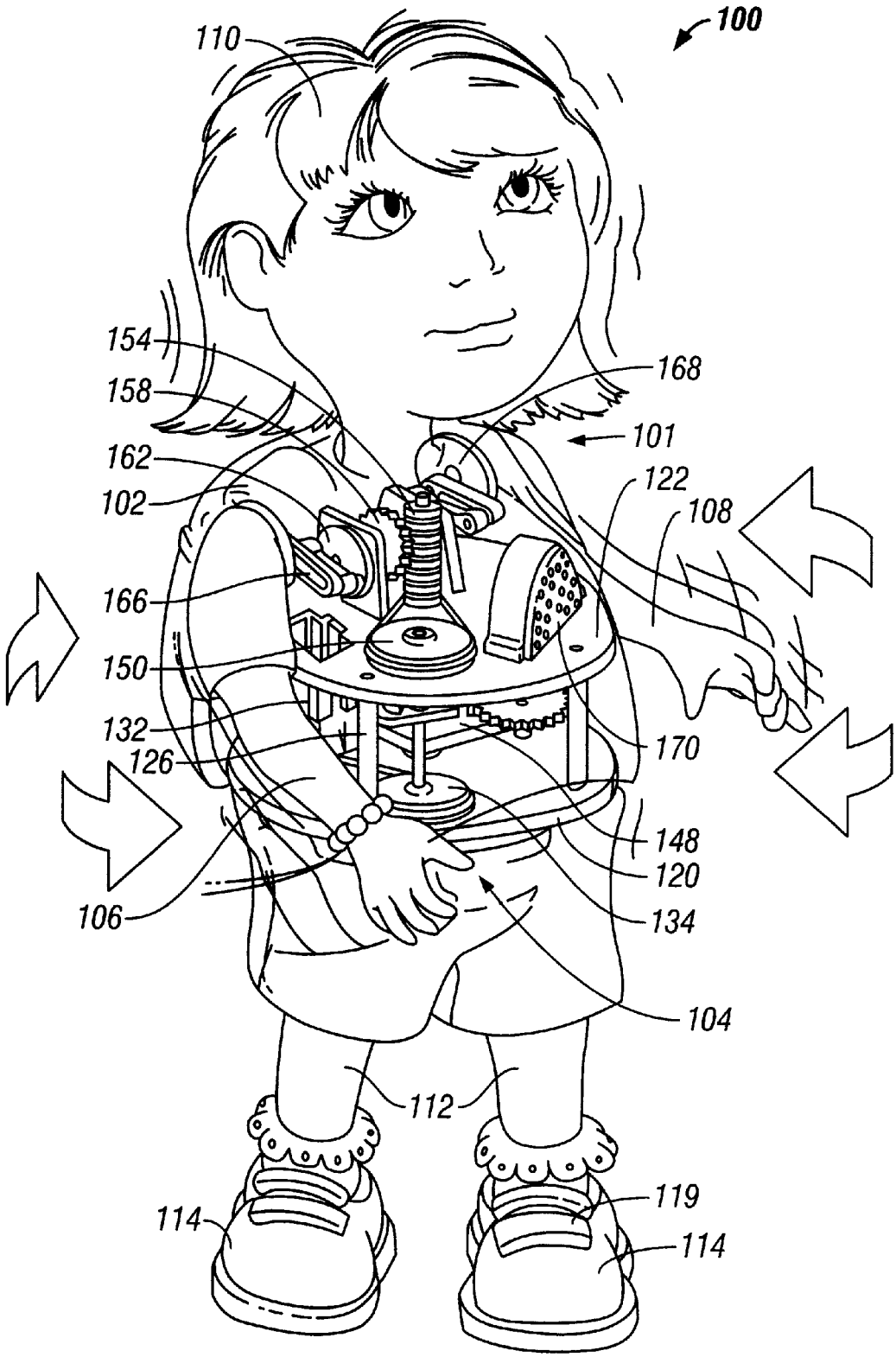
FIG. 1 illustrates a twisting and dancing figure in accordance with the present invention, and shows a portion of the internal components.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a twisting and dancing figure 100 is illustrated in accordance with the present invention. The figure 100 has a body 101 defined in upper and lower torso sections 102 and 104, respectively. Attached to the upper body 102 is a pair of arms 106 and 108 that are driven up and down. A head 110 is freely attached to the upper torso section 102 such that when the body 101 twists, the head swivels to the left and right independently of the twisting body 101. A pair of legs 112 is attached to the lower torso section 104 and includes a pair of shoes 114. The shoes 114 and legs 112 provide support for the figure 100 such that the figure 100 is free-standing or does not require a base or platform for support in order to maintain balance when moving.

Figure 2:
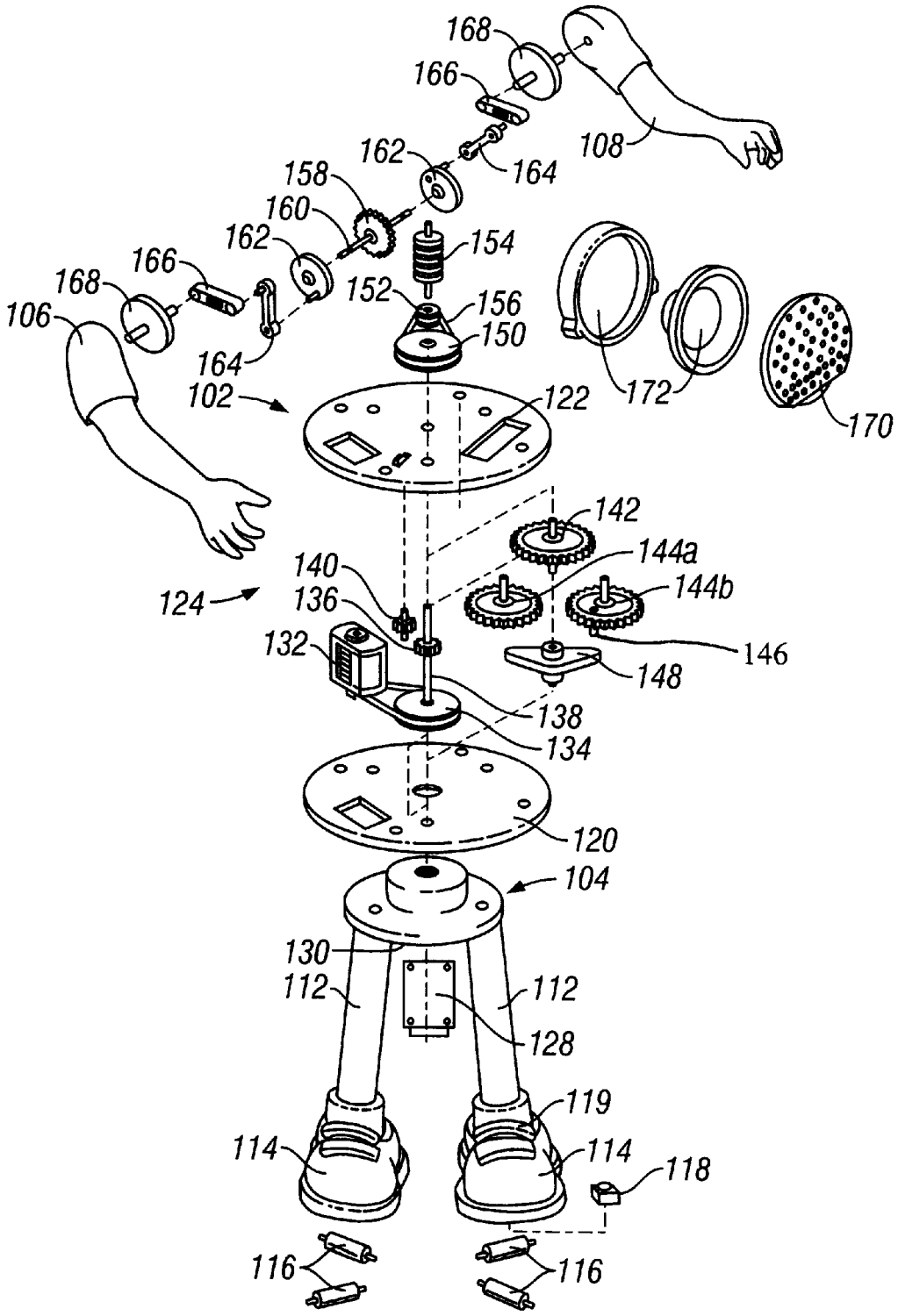
FIG. 2 illustrates an exploded view of the internal components.

Referring now to FIG. 2, as mentioned above the twisting and dancing figure 100 includes a lower torso section 104 and a pair of legs 112 that attaches separately to a pair of shoes 114. A pair of rollers 116 is placed on the bottom of each shoe 114 to accentuate the twisting action of the figure 100 and to add to the realism of the figures' 100 movement. An activation button 118 and corresponding switch 119 may be attached to one of the shoes 114. However, the exact placement of the activation button 118 and switch 119 may be moved without changing the scope of the invention.

Rotatably or pivotally attached to the lower torso section 104 is a lower plate 120. The lower plate 120 connects to an upper plate 122 (defined in the upper torso sections 102) to form a midsection region 124. The upper plate 122 is secured to the lower plate 120 by a plurality of rods 126 (shown in FIG. 1). A circuit board 128 attached to the underside 130 of lower torso sections 104 may be in communication with other components attached to the upper plate 122 by wires or connections (not shown). The figure 100 further includes a power supply (not shown) that when activated provides power to operate the figure 100.

The twisting and dancing motion of the figure 100 is created by a motor 132, secured between the plates 120 and 122. The motor 132 drives a lower pulley 134, which rotates a small pinion 136 that is secured to an axle 138 that is also secured to the lower pulley 134. The small pinion 136 drives a slider gear 140 that engages and drives a combo gear 142, only when the motor 132 is operating in a forward direction. The combo gear 142 includes a left and right cam gear 144*a* and 144*b*, respectively. Moreover, the combo gear 142 drives the cam gears in opposite directions. The cam gears 144*a* and 144*b* are aligned so that lobes 146*a* and 146*b*, extending downwardly from the respective cam gears are out of phase with each other, preferably by 180°. As the cam gears 144*a* and 144*b* rotate, one of the lobes will hit a bumper 148, which is secured to the lower torso section 104 such that the bumper 148 does not move.

Figure 3A:
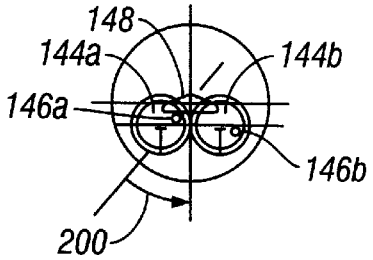
FIG. 3*a* illustrates the figure twisting to the right and the cams rotating as viewed from the top.
Figure 3A:
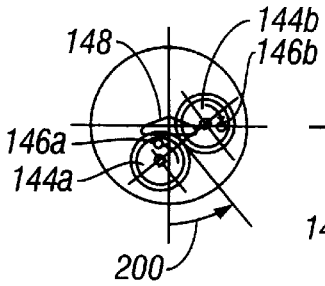
Figure 3A:
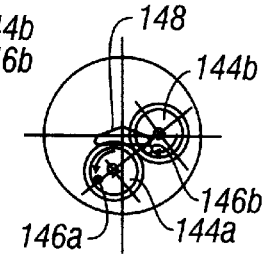
Figure 3A:
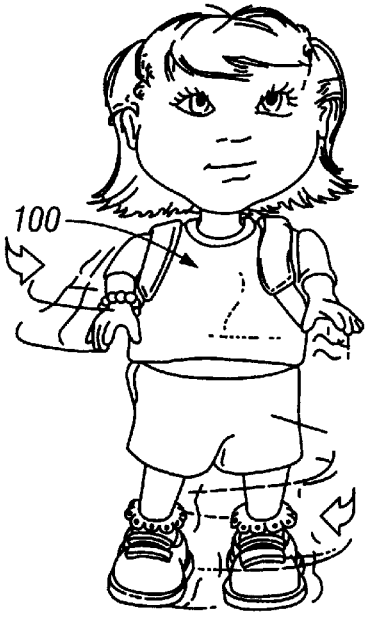
Figure 3B:
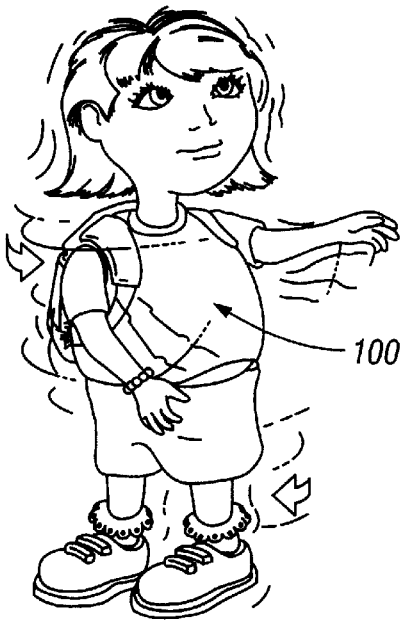
FIGS. 3*b*, 3*b*.1 and 3*b*.2 illustrate the figure twisting to the right and the cams rotating until the right cam hits the bumper.
Figure 3C:
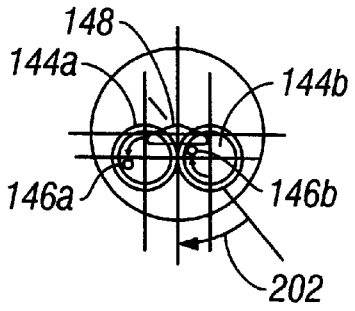
FIG. 3*c* illustrates the figure twisting to the left and the cams rotating as viewed from the top.
Figure 3C:
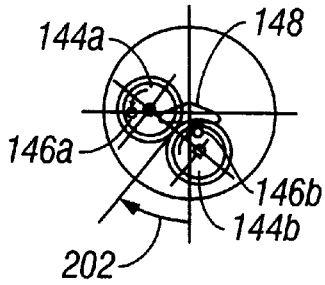
Figure 3C:
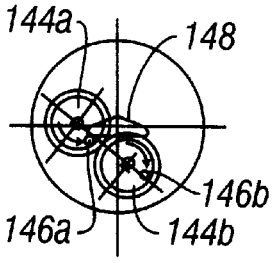
Figure 3C:
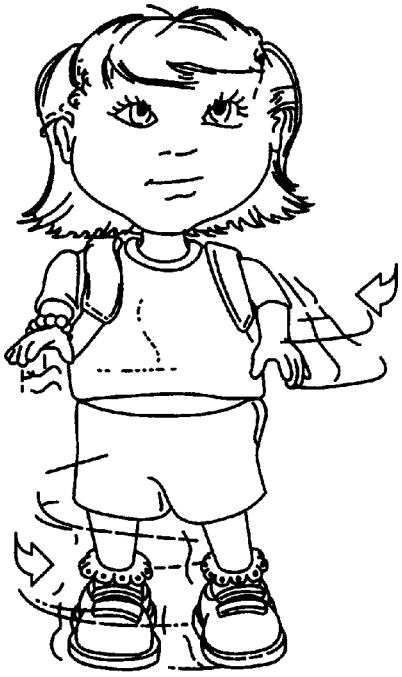
Figure 3D:
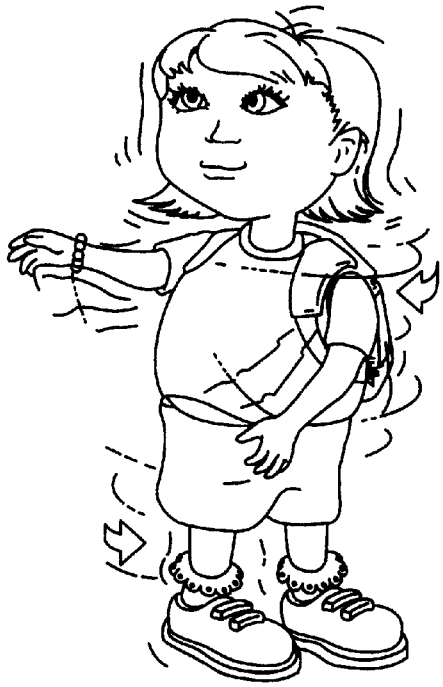
FIGS. 3*d*, 3*d*.1 and 3*d*.2 illustrate the figure twisting to the left and the cams rotating until the left cam hits the bumper.

As illustrated in FIG. 3*a* the figure 100 is rotating to the right or counterclockwise (as viewed from the top) indicated by arrow 200. The left cam gear 144*a* is rotating counterclockwise and the right cam gear 144*b* is always rotating clockwise. As the figure 100 continues to rotate counterclockwise, illustrated in FIGS. 3*b*, 3*b*.1 and 3*b*.2, the right lobe 146*b* attached to the right cam gear 144*b* eventually comes into contact with the bumper 148 (FIG. 3*b*.2), which stops the counterclockwise rotation of the figure 100. However, since the motor is still rotating the combo gear 142 and hence rotating the cam gears 144*a* and 144*b*, the right lobe 146*b* pushes against the bumper 148. This causes the horizontal plates 120 and 122 (and the upper body 102) to pivot about the lower torso section 104 in the opposite direction as the force, or in the clockwise direction, indicated by arrow 202 in FIG. 3*c*. The upper body 102 will continue to pivot in the clockwise direction, FIGS. 3*d* and 3*d*.1 and 3*d*.2, until the left lobe 146*a* attached to the left cam 144*b* comes in contact with the bumper 148, stopping the clockwise direction of the upper body 102 (FIG. 3*d*.2). Upon which, the left cam 144*b* still being forced to rotate counterclockwise causes the upper body 102 to pivot in the opposite direction, counterclockwise, as illustrated in FIG. 3*a*. The movement will continue to alternate as the lobes 144*b* and 146*b* alternately push against the bumper.

To create movement in the arms, the axle 138 projects through the upper plate 122 to drive an upper pulley 150. The upper pulley 150 drives a second upper pulley 152 via a second upper pulley drive belt 156. The second upper pulley 152 is connected to a worm gear 154, which drives an arm drive gear 158. Connected to the arm drive gear, 158 on an arm drive gear axle 160 are left and right arm cams 162. A crank 164 connected to each arm cam 162 is further connected to a lever 166, which is connected to an arm mount disc 168. Each arm 106 and 108 is then connected to one of the arm mount discs 168. As the arm worm gear 154 rotates the arm drive gear 158, the arm cams 162 rotate, which moves the cranks 164 up and down. The up and down motion is transferred through the lever 164 to the arm mount discs 168 and ultimately to the arms 106 and 108. The arms are preferably aligned so that one arm is always moving up when the other arm is moving down, or 180° out of phase with each other. However, the phase may be changed without changing the scope of the invention.

Moreover, the arms 106 and 108 are driving up or down regardless of which direction the motor 132 is running (forwards or backwards). However, the figures' 100 body will only twist to the left or right when the motor 132 is running in the forward direction, because the slider gear 140 only engages the combo gear 142 when the motor 132 is run forwards.

To activate the twisting and dancing figure 100 a user presses the activation switch 119 on the shoe 114. The figure 100 will then begin to emit music or sounds through a speaker 170 mounted within a speaker housing 172 on the upper plate 122. The motor 132 will then begin to run in a forward direction causing the mid-section 124 to twist to the left and right and the arms 106 and 108 to move up and down. The motor 132 may also run in a reverse direction. As mentioned above, the motor 132 only rotates the body when running forwards, as such when the motor 132 operates in a reverse direction the slider gear 140 disengages the combo gear 142, whereby the body 101 of the figure 100 will not twist. However, the arms 106 and 108 will continue to move up and down, since the arms are continuously driven by the motor 132 regardless of the direction the motor 132 is running. When the body 101 twists the momentum may also cause the legs 112 to slide across a surface, since the shoes 114 include rollers 116. As noted herein, the twisting or motion of the body is not controlled by having a reciprocating motor, the motion is created by the combo gear alternating against the bumper.

In addition thereto, a sound activation chip (not shown) or motion activation chip with appropriate sensors (not shown) may also be incorporated into the figure 100 separately or in combination therewith. While the sound activation chip would activate the motor 132 upon the detection of a sound, the motion activation chip would activate the figure 100 upon detecting motion. In the instance of motion activation chip the figure 100 would still require pre-programmed sounds or music to play when activated.

From the foregoing and as mentioned above, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

We claim:

1. A twisting figure having a head and body portion that includes a pair of arms and a lower leg section separately extending therefrom, the figure further comprising:

a housing formed in the body portion and containing a motor secured between upper and lower horizontal plates both pivotally secured to the lower leg section;

a bumper positioned between the horizontal plates and secured through the lower horizontal plate to the lower leg section; and a combo gear secured to the upper horizontal plate and in communication with the motor, the combo gear includes lobes positioned out of phase with one another by a predetermined phase angle and positioned such that when the motor is operating, the lobes come into contact with and alternately push against the bumper such that the pair of horizontal plates pivot back and forth along a horizontal plane causing the body portion of the twisting figure to move therewith.

2. The figure of claim 1, wherein the housing further contains a worm gear in communication with the motor, the worm gear is further meshed to a pair of arm drive gears that are separately in communication with one of the arms, of the pair of arms, such that when the arm drive gears rotates the pair of arms move upwardly or downwardly.

3. The figure of claim 2 further comprising a slider gear in communication with the motor and positioned to engage and rotate the combo gear only when the motor is operating in a forward direction.

4. The figure of claim 1 further comprising a pair of shoes attached to the lower leg section and a pair of freely rotatable rollers attached under the shoes.

5. The figure of claim 1 further comprising an activation button that when pressed activates the motor.

6. The figure of claim 1 further comprising a speaker than emits pre-programmed sounds and music.

7. A twisting figure having a head and body portion including a pair of arms and a lower leg section separately, the figure comprising:

a housing formed in the body portion and containing a motor secured between upper and lower horizontal plates that are pivotally secured to the lower leg section, the housing further contains a combo gear secured to the upper horizontal plate and in communication with the motor, the combo gear is arranged to alternately push against a bumper that is secured through the lower horizontal plate to the lower leg section, wherein when the combo gear alternately pushes against the bumper, the pair of horizontal plates pivot back and forth along a horizontal plane causing the body portion to move therewith; and a worm gear in communication with the motor, the worm gear is further meshed to the arms, such that when the worm gear rotates, the pair of arms move upwardly or downwardly.

8. The figure of claim 7 further comprising a slider gear in communication with the motor and positioned to engage and rotate the combo gear only when the motor is operating in a forward direction.

9. The figure of claim 8 further comprising a pair of shoes attached to the lower leg section and a pair of freely rotatable rollers attached under the shoes.

10. The figure of claim 8 further comprising an activation button that when pressed activates the motor.

11. The figure of claim 8 further comprising a speaker that emits pre-programmed sounds and music.

12. The figure of claim 8 further including a sound activation device such that the motor is activated in response to sound.

13. The figure of claim 8 further including a motion activation device such that the motor is activated in response to motion.

* * * * *